US006551439B1

(12) United States Patent
Hill, IV et al.

(10) Patent No.: US 6,551,439 B1
(45) Date of Patent: Apr. 22, 2003

(54) ULTRAVIOLET LABELING APPARATUS AND METHOD

(75) Inventors: William J. Hill, IV, Landenberg, PA (US); Thomas C. McNutt, Newark, DE (US)

(73) Assignee: Applied Extrusion Technologies, Inc., New Castle, DE (US)

( * ) Notice: Subject to any disclaimer, the term of this patent is extended or adjusted under 35 U.S.C. 154(b) by 125 days.

(21) Appl. No.: 09/588,333

(22) Filed: Jun. 6, 2000

(51) Int. Cl.[7] ..... B65C 9/20

(52) U.S. Cl. ..... 156/273.3; 156/275.5; 156/275.7; 156/DIG. 28; 156/DIG. 34

(58) Field of Search ..... 156/256, 272.2, 156/273.3, 275.5, 275.7, DIG. 28, DIG. 29, DIG. 34, DIG. 36

(56) References Cited

U.S. PATENT DOCUMENTS

| | | | |
|---|---|---|---|
| 2,725,156 | A | 11/1955 | Manas |
| 2,830,724 | A | 4/1958 | Manas |
| 2,860,804 | A | 11/1958 | Sherrington |
| 3,116,193 | A | 12/1963 | Ehlenbeck |
| 3,658,630 | A | 4/1972 | Stauber |
| 3,823,050 | A | 7/1974 | La Mers |
| 3,904,466 | A | 9/1975 | Jones et al. |
| 3,938,698 | A | 2/1976 | McDavid, Jr. et al. |
| 3,953,278 | A | 4/1976 | Smith et al. |
| 3,982,185 | A | 9/1976 | Shinn et al. |
| 4,072,552 | A | 2/1978 | Ewing |
| 4,123,310 | A | 10/1978 | Varon et al. |
| 4,181,752 | A | 1/1980 | Martens et al. |
| 4,272,311 | A | 6/1981 | D'Angelo et al. |
| 4,279,687 | A | 7/1981 | Buchholz et al. |
| 4,547,250 | A | 10/1985 | Murayama |
| 4,861,621 | A | 8/1989 | Kanzaki |
| 4,946,531 | A | 8/1990 | Crouch et al. |
| 4,977,006 | A | 12/1990 | Smith et al. |
| 5,028,290 | A | 7/1991 | Cruiel |
| 5,152,858 | A | 10/1992 | Winter |
| 5,174,852 | A | 12/1992 | Zepf |
| 5,215,622 | A | 6/1993 | Schmelzer |
| 5,234,730 | A | 8/1993 | Lautenschlaeger et al. |
| 5,290,388 | A | 3/1994 | Zepf |
| 5,427,642 | A | 6/1995 | Akiguchi et al. |

(List continued on next page.)

FOREIGN PATENT DOCUMENTS

| | | |
|---|---|---|
| DE | 197 49 632 C 1 | 3/1999 |
| GB | 2 321 044 A | 7/1998 |
| WO | WO97/35290 | 9/1997 |
| WO | WO99/55517 | 11/1999 |

OTHER PUBLICATIONS

Krones Publication #D–UT0–00–100–E, Date: Jan. 20, 1997, Revision 07, Basics of Rotary Labeling (Cold Glue).

Patent Cooperation Treaty (PCT) International Search Report dated Jan. 3, 2002 for International Application No. PCT/US 01/18352 filed Jun. 6, 2001 for Applicant Applied Extrusion Technologies.

*Primary Examiner*—Michael W. Ball
*Assistant Examiner*—John T. Haran
(74) *Attorney, Agent, or Firm*—Caesar, Rivise, Bernstein, Cohen & Pokotilow, Ltd.

(57) ABSTRACT

This invention relates to a UV curable system of the type for continuously applying a UV curable adhesive to labels, at least partially curing the adhesive on the labels to render the adhesive tacky and thereafter applying the labels to discrete containers through the tacky adhesive layer. Most preferably the labels are cut and stack labels retained in a dispensing magazine prior to the application of the UV adhesive to the labels, and most preferably both the labels and the UV curable (and cured) adhesive are clear, and the clear labels with the clear tacky adhesive thereon preferably are adhered to clear glass containers, e.g. soda bottles, beer bottles and the like.

7 Claims, 3 Drawing Sheets

U.S. PATENT DOCUMENTS 5,458,729 A 10/1995 Galchefski et al.
5,464,495 A 11/1995 Eder
5,466,325 A 11/1995 Mizuno et al.
5,518,569 A 5/1996 Achilles et al.
5,658,631 A 8/1997 Bernstein et al.
5,705,024 A 1/1998 Bainbridge et al.
5,714,269 A 2/1998 Munoz Madrid
5,785,803 A 7/1998 Schiessl
5,843,598 A 12/1998 Ueda et al.
5,885,401 A 3/1999 Eiban
5,893,958 A 4/1999 Cummings et al.
5,897,722 A 4/1999 Bright
5,992,314 A 11/1999 Lorenz et al.
6,007,658 A 12/1999 Calvert
6,009,926 A 1/2000 Vicktorius et al.
6,013,693 A 1/2000 Takahashi et al.
6,024,830 A 2/2000 Nedblake et al.
6,242,504 B1 * 6/2001 Meyer-Roscher et al. ..... 156/272.2
6,401,787 B1 * 6/2002 Tsutsumi et al. ..... 156/497

* cited by examiner 14
20
18
22
58
20
56
56
16
52
24
32
50
34
32
42
43
20
52
40
36
32
32
26
54
31
28
29
20
12

FIG. 2
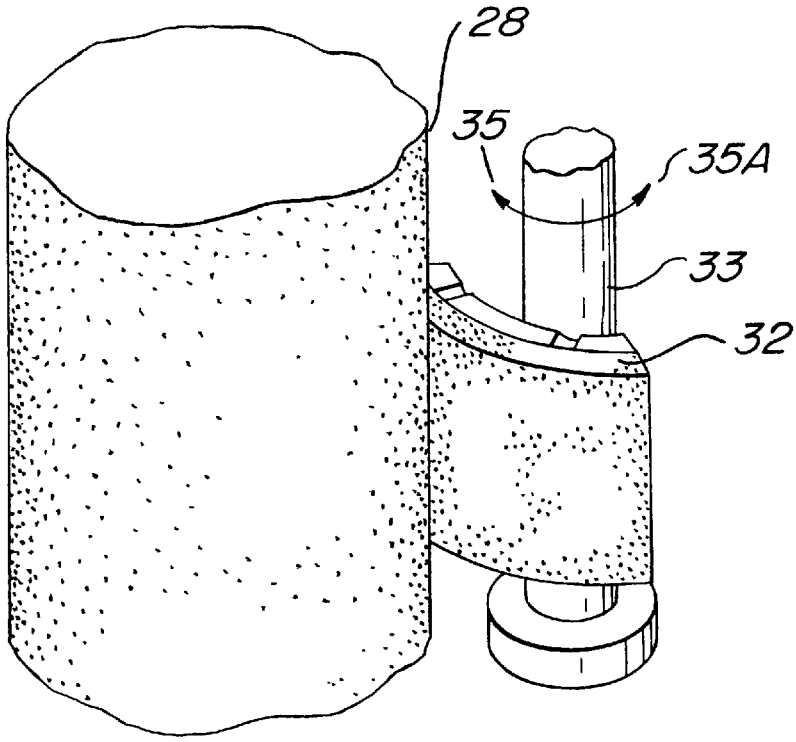
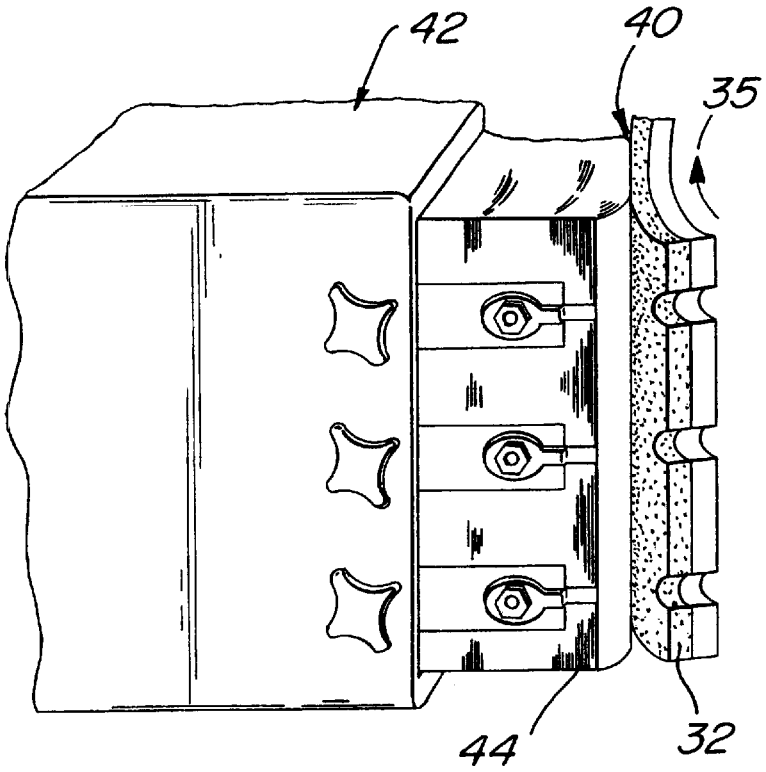
FIG. 3

ULTRAVIOLET LABELING APPARATUS AND METHOD

FIELD OF THE INVENTION

This invention relates generally to a labeling apparatus and method for applying labels to containers, and more particularly to a labeling apparatus and method employing a UV curable pressure sensitive adhesive for adhering a label to a container. Preferably this invention relates to the application of cut and stack labels, both opaque and transparent, to a container through a UV pressure sensitive curable adhesive.

The UV curable pressure sensitive adhesives used in this invention become tacky, or pressure sensitive, upon exposure to UV radiation.

BACKGROUND ART

A number of prior art systems exist for applying labels to containers. These systems employ either continuous roll fed labels or cut and stack labels.

Prior art labeling apparatus and methods employing labels in continuous roll form include label cutting and registration means for severing discrete labels from the roll and then registering them for attachment to the containers through a transfer vacuum drive system. In these prior art systems a hot melt adhesive generally is employed; being applied to both the leading and trailing edge of the back side of the labels for permitting attachment of the labels to the containers.

Although the above-described system is being commercially utilized, it does include a number of drawbacks for various applications. First, continuous roll fed labeling devices require both label cutting and registration units, which increase the complexity of the system. Second, hot melt adhesives are, at best, generally cloudy or milky in appearance and therefore are not effectively utilized to apply clear or transparent labels in a uniform fashion to clear containers. The uniform attachment of clear or transparent labels to clear containers, e.g., clear glass or plastic beer and soda bottles, is very desirable, providing a very clean finish, and also permitting the product inside of the bottle to be clearly and easily viewed through the label.

A further deficiency in connection with the use of hot melt adhesives is that high temperatures generally are required to apply the labels to the containers. The application of high temperatures to the containers often is undesired.

It is known to employ continuous rolls of transparent pressure sensitive labels for application to clear containers. However, as discussed above, the use of these continuous rolls require cutting and registration units that increase the complexity of the system. Moreover, the rolls of pressure sensitive labels often include a release liner covering the adhesive surface, thereby necessitating the removal of the release liner from the label during the continuous process. This also introduces an undesired complexity into the system.

It also is known to apply cut and stack labels (i.e., labels that have been cut off line and are retained in a stack within a dispensing magazine) to containers, such as bottles, in a continuous label application system. In accordance with this prior art system, a cold glue adhesive, which is water soluble, is applied to a glue transfer pad by a rubber transfer roll, and the glue transfer pad is moved into contact with the lower label of the stack to both apply glue to that label and remove the label from the stack onto the pad through surface adhesion with the adhesive. Thereafter, the label, with the cold glue thereon, is moved to a transfer drum, from where it is then applied to a container, such as a glass bottle. These cold glue adhesives generally have been utilized only in connection with paper labels that are capable of absorbing the moisture from the water soluble adhesives. In other words, systems employing water soluble cold glue adhesives are not well suited for use with non-porous, plastic labels.

Based on the deficiencies of the existing prior art systems, a need exists for a labeling apparatus and method that is not required to handle a tacky adhesive throughout the label handling and applying operations, and that is effective for use with plastic labels, preferably transparent plastic labels, for adhering such labels to containers; preferably clear glass bottles such as beer or soda bottles. Most preferably a need exists for the aforementioned type of system that does not require the use of label cutting and registration units of the type generally employed in labeling apparatus and methods that handle continuous roll fed labels; although, in accordance with the broadest aspects of this invention, the process can be employed with continuous roll fed label stock.

OBJECTS OF THIS INVENTION

It is a general object of this invention to provide a method and apparatus for applying labels to containers that are reliable in operation.

It is a further object of this invention to provide a method and apparatus for applying labels devoid of any release liner to containers in a reliable manner.

It is a further object of the most preferred embodiment of this invention to provide a method and apparatus for applying transparent labels to clear containers in a reliable manner.

It is a further object of the most preferred embodiment of this invention to provide a method and apparatus for applying labels to containers that do not require the use of label cutting and registration devices of the type included in labeling systems that handle labels in continuous roll form.

It is still a further object of this invention to provide a method and apparatus for applying a label to a container wherein a tacky adhesive is not required to be handled throughout the entire label forming and applying operations.

SUMMARY OF THE INVENTION

The above and other objects of this invention are achieved in a UV labeling apparatus and method wherein a UV curable adhesive, which is non-tacky, is applied to the surface of a label to be attached to a bottle, and the label, with the UV curable adhesive thereon, is then sequentially fed through a UV cure operation to render the adhesive tacky and then to a station for immediately applying the label to a surface of the container through the tacky adhesive on the label.

In accordance with the most preferred embodiment of this invention, the labels are individual, cut and stack labels retained in a magazine, and the UV curable adhesive is applied to a lower surface of each label in the stack through a rotating transfer pad that moves sequentially through an adhesive application station in which a measured quantity of UV adhesive is transferred to the exposed surface of the pad, and then to a transfer station where the exposed surface of the pad with the adhesive thereon engages a lower surface of the lowermost label in the stack to both apply the adhesive to that label and remove the label from the stack through the surface adhesion created by the UV liquid.

In the most preferred embodiment of this invention, the individual labels carried on the transfer pads are then directed to a transfer assembly, wherein the individual labels are released from the pads and directed by the transfer assembly through a UV cure station in which the UV adhesive is rendered tacky, and then into a label application station for transferring the individual labels, with the tacky adhesive thereon, to the outer surface of a container, preferably a glass container, such as a beer or soda bottle.

BRIEF DESCRIPTION OF THE DRAWING

Other objects and many attendant features of this invention will become readily appreciated as the same becomes better understood by reference to the following detailed description when considered in connection with the accompanying drawings wherein:

FIG. 2 is an enlarged, fragmentary isometric view of a portion of the adhesive application station wherein a UV adhesive is transferred to the exposed surface of a rotating transfer pad, prior to the transfer pad being directed into a transfer station for receiving a label thereon;

FIG. 3 is an enlarged, fragmentary isometric view illustrating the engagement of a rotating transfer pad with UV adhesive thereon with the lower most label in a stack of such labels.

DESCRIPTION OF THE PREFERRED EMBODIMENT OF THE INVENTION

Figure 1:
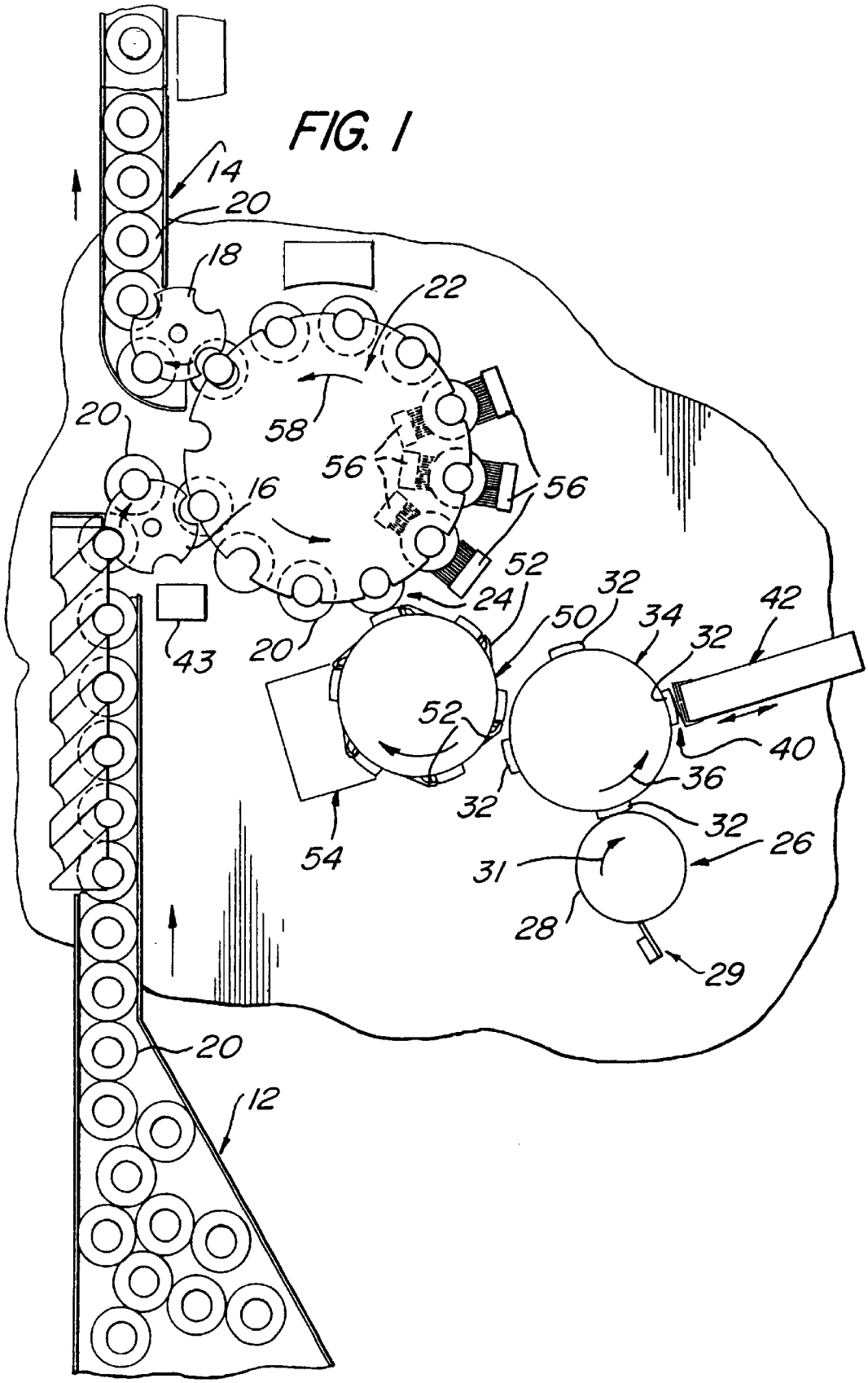
FIG. 1 is a schematic, plan view illustrating the method and apparatus of this invention.

Referring to FIG. 1, a method and apparatus for applying labels to containers in accordance with this invention are shown generally at 10. The method and apparatus employs an inlet conveyor section 12, an outlet conveyor section 14 and rotating bottle-transfer members 16 and 18 for transferring bottles 20 from the inlet conveyor section to a rotating turret 22, and for removing bottles from the rotating turret to the exit conveyor section 14, respectively, after the bottles have been directed through label application station 24.

It should be understood that the construction of the inlet conveyor section 12, outlet conveyor section 14, rotating bottle-transfer members 16 and 18 and rotating turret 22 are all of a conventional design employed in prior art labeling apparatus and methods. For example, Krones manufactures a line of rotary labeling equipment including a inlet conveyor section 12, an outlet conveyor section 14, rotating bottle-transfer members 16 and 18 and a rotating turret 22 of the type that can be employed in the present invention.

Referring specifically to FIGS. 1 and 2, the method and apparatus of this invention employ an adhesive application station 26 that includes a gravure applicator roll 28 of the type that generally is used in gravure printing systems. The gravure applicator roll 28, in conjunction with conventional wiper/sealing blades (not shown) seals the open end of a adhesive supply chamber 30 as the roll rotates in communication with the adhesive supply chamber in the direction of arrow 32. Thus, the exposed outer surface of the gravure applicator roll 28 receives a metered amount of UV curable adhesive retained in the chamber 30 and engages the outer exposed surfaces of transfer pads 32 disposed about the periphery of a rotating support member 34 that is rotated in the direction of arrow 36. In the preferred embodiment of this invention, the transfer pads 32 can be made of rubber and will receive the UV curable adhesive from the surface of the gravure roll 28 as the gravure roll and the transfer pads on rotating member 34 are moved into engagement with each other.

Referring to FIGS. 1 and 3, the transfer pads 32, with the UV curable adhesive thereon, are directed sequentially by the rotating member 34 to a transfer station 40. The transfer station 40 includes a magazine 42 retaining a stack of cut labels 44 therein.

Still referring to FIGS. 1 and 3, the transfer pads 32 with the UV curable adhesive thereon are rotated into engagement with the lowermost label 44 in the magazine 42 to apply the adhesive to that label and remove that label through surface adhesion with the adhesive in a well-known manner.

Details of the construction of the magazine 42 are omitted since the magazine is a well-known component in cut and stack label equipment and does not form a part of the present invention. In particular, Krones rotary cut and stack labeling equipment employ magazines of the type that can be used in the present invention.

Figure 4:
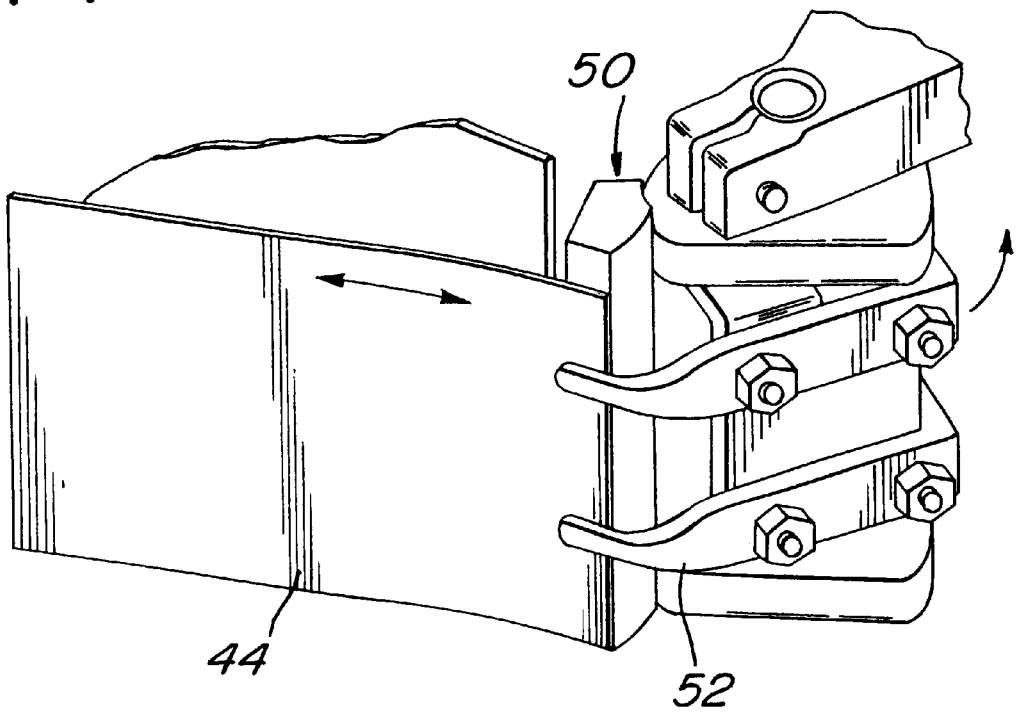
FIG. 4 is an enlarged, fragmentary isometric view illustrating, in schematic form, the retention of a label on a transfer assembly that directs the label through a UV cure station and then to the label application station.

Referring to FIGS. 1 and 4, the transfer pads 32, with the labels thereon, are then rotated to a transfer assembly shown generally at 50. This transfer assembly includes a plurality of cam operated gripping members 52 disposed about the periphery thereof for engaging labels 44 carried by the transfer pads 32 and transferring the labels to the transfer assembly 50. The transfer assembly 50 is of a conventional design, and therefore the details of this assembly, including the cam operation of the gripping members 52 is omitted, for purposes of brevity.

Referring to FIG. 1, the rotary transfer assembly 50, with labels 44 thereon, is directed through a UV cure section 54. The UV cure section includes an ultraviolet light source for exposing the adhesive on the labels 44 to UV radiation, thereby rendering the adhesive tacky.

It should be understood that the UV curable adhesive is in a non-tacky state until it passes through the UV cure station 54. Thus, in accordance with this invention, the apparatus and method are employed without the need to handle any tacky adhesive materials throughout the entire processing operation. Stating this another way, the UV curable adhesive is only rendered tacky at a location closely adjacent the label application station 24.

Still referring to FIG. 1, each of the labels 44 is directed from the UV cure station 54 in a tacky condition and is immediately rotated into a position for engaging the outer periphery of a bottle 20 carried on the turret 22 in the label application station 24. It should be noted that the spacing of the labels on the transfer assembly 50 and the speed of rotation of the transfer assembly are timed with the speed of rotation of the rotating turret 22 such that each label carried on the transfer assembly 50 is sequentially directed into engagement with an adjacent bottle carried on the rotating turret.

Still referring to FIG. 1, each of the labels 44 is applied essentially at its midline to the periphery of an adjacent bottle 20, thereby providing outer wings extending in opposed directions from the center line of the label, which is adhered to the bottle. This manner of applying a label to a bottle is conventional and is employed in Krones rotary labeling equipment.

After a label 44 is initially adhered to a bottle 20 in the label application station 24, the rotating turret 22 directs each bottle, with the label attached thereto, through a series of opposed inner and outer brushes 56. As the bottles are directed through the series of brushes the bottles are also oscillated back and forth about their central axis to thereby create an interaction between the bottles, labels and brushes to effectively adhere the entire label to the periphery of each bottle. This brush arrangement and the system for oscillating the bottles as they move past the brushes are of a conventional design and are well known to those skilled in the art.

Still referring to FIG. 1, after the labels 44 have been completely adhered to the bottles 20, the bottles are carried by the rotating turret 22 in the direction of arrow 58 to the bottle-transfer member 18, at which point the bottles are transferred to the outlet conveyor section 14 for subsequent packaging.

It should be understood that the UV adhesives that can be employed in this invention are well known, and are in a non-tacky state until they are exposed to UV radiation. Thus, as noted earlier herein, the apparatus and method of this invention are not required to handle a tacky adhesive throughout the majority of the process. This provides for a cleaner running operation.

Moreover, UV adhesives are extremely well suited for use with clear labels since they are applied as a clear coating that does not detract from the clarity of the film. This permits clear films to be adhered to clear bottles to provide a highly attractive labeled product.

Moreover, although the preferred embodiment of this invention relates to the application of cut and stack labels to bottles, more particularly, to the application of clear cut and stack labels to clear bottles, the method of this invention, in accordance with the broadest respect thereof, can be employed to handle continuous roll label stock for application to bottles and other containers. In this latter system, the equipment and process is more complicated by the need to sever the discrete labels from the continuous roll stock. However, after separation, the labels can be handled by rotary transfer devices to bring the individual cut labels into and through a UV cure station to render the adhesive of the labels tacky just prior to application of the labels to the bottles or other. containers.

Without further elaboration, the foregoing will so fully illustrate our invention that others may, by applying current or future knowledge, readily adapt the same for use under various conditions of service.

What we claim as the invention is:

1. A continuous method of applying individual stacked, plastic labels to containers including the sequential steps of:

maintaining a stack of individual, stacked plastic labels in a dispensing magazine;

applying a UV curable adhesive to a transfer member;

causing said transfer member with the adhesive theron to engage an exposed, lower surface of a lowermost label in the stack to apply said UV curable adhesive to said lower surface and to remove the lowermost label from the stack and releasably secure said lowermost label to said transfer member for subsequent transport of the lowermost label throught a radiation cure station;

directing the label with the UV curable adhesive theron through a UV cure station for radiating the adhesive with UV radiation to increase the tackiness of the adhesive, and thereafter;

applying the label through the tacky adhesive component thereof to the outer surface of a container.

2. The method of claim 1, wherein the label is a transparent plastic label and the UV adhesive is applied uniformly over the surface of the label prior to directing the label through the UV cure station.

3. The method of claim 1, wherein the label is an opaque plastic label and the UV adhesive is applied uniformly over the surface of the label prior to directing the label through the UV cure station.

4. The method of claim 1, wherein the labels are transparent and the UV curable adhesive is a clear adhesive after curing and is applied as a substantially continuous layer substantially uniformly over the surface of the label prior to curing, and wherein said label is applied to the container by adhering the label substantially continuously and uniformly to the outer surface of the container through the substantially continuous layer of the clear UV cured adhesive.

5. The method of claim 1, including the step of sequentially applying the UV curable adhesive to sucessive lowermost labels in the stack by successively engaging the lowermost surface of the successive lowermost labels in the stack with the transfer member including the UV curable adhesive thereon.

6. The method of claim 5, wherein the transfer member includes a plurality of transfer pads that are carried on a rotating member, with each transfer pad being directed sequentially past an adhesive application station at which the UV curable adhesive is applied to an exposed surface of each pad and thereafter directing each pad into engagement with the lower surface of the lowermost label in the stack.

7. The method of claim 6, wherein the adhesive is applied to each of the pads through a gravure roll driven through a metering device to apply the adhesive onto the surface of the gravure roll for transfer to the exposed surface of each of the transfer pads.

* * * * *